US010563293B2

(12) United States Patent
Bockenstedt et al.

(10) Patent No.: US 10,563,293 B2
(45) Date of Patent: Feb. 18, 2020

(54) METHODS FOR PROCESSING NICKEL-BASE ALLOYS

(71) Applicant: ATI PROPERTIES LLC, Albany, OR (US)

(72) Inventors: Kevin Bockenstedt, Waxhaw, NC (US); Ramesh S. Minisandram, Charlotte, NC (US)

(73) Assignee: ATI Properties LLC, Albany, OR (US)

( * ) Notice: Subject to any disclaimer, the term of this patent is extended or adjusted under 35 U.S.C. 154(b) by 781 days.

(21) Appl. No.: 14/961,178

(22) Filed: Dec. 7, 2015

(65) Prior Publication Data

US 2017/0159162 A1 Jun. 8, 2017

(51) Int. Cl.

| | |
|---|---|
| ***C22F 1/10*** | (2006.01) |
| ***C22C 30/00*** | (2006.01) |
| ***B22F 3/24*** | (2006.01) |
| ***C22C 1/04*** | (2006.01) |
| ***C22C 19/05*** | (2006.01) |

(52) U.S. Cl.

CPC ..... *C22F 1/10* (2013.01); *B22F 3/24* (2013.01); *C22C 1/0433* (2013.01); *C22C 19/056* (2013.01); *C22C 30/00* (2013.01); *B22F 2003/248* (2013.01); *B22F 2998/10* (2013.01)

(58) Field of Classification Search

CPC ..... C22F 1/10
USPC ..... 148/677
See application file for complete search history.

(56) References Cited

U.S. PATENT DOCUMENTS

| | | | |
|---|---|---|---|
| 3,046,108 | A | 7/1962 | Eiselstein |
| 3,705,827 | A | 12/1972 | Muzyka et al. |
| 3,785,877 | A | 1/1974 | Bailey |
| 3,865,581 | A | 2/1975 | Sekino et al. |
| 4,083,734 | A | 4/1978 | Boesch |
| 4,173,471 | A | 11/1979 | Mal et al. |
| 4,219,592 | A | 8/1980 | Anderson et al. |
| 4,236,943 | A | 12/1980 | Korenko et al. |
| 4,336,292 | A | 6/1982 | Blair |
| 4,371,404 | A | 2/1983 | Duhl et al. |
| 4,608,094 | A | 8/1986 | Miller et al. |

(Continued)

FOREIGN PATENT DOCUMENTS

| | | | |
|---|---|---|---|
| CN | 1083121 | A | 3/1994 |
| CN | 1279299 | A | 1/2001 |

(Continued)

OTHER PUBLICATIONS

Aerospace Material Specification—AMS 5441, Issued Sep. 2006, 8 pages.

(Continued)

*Primary Examiner* — Brian D Walck

(74) *Attorney, Agent, or Firm* — K&L Gates LLP; Robert J. Toth

(57) ABSTRACT

A method for heat treating a powder metallurgy nickel-base alloy article comprises placing the article in a furnace at a start temperature in the furnace that is 80° C. to 200° C. below a gamma prime solvus temperature, and increasing the temperature in the furnace to a solution temperature at a ramp rate in the range of 30° C. per hour to 70° C. per hour. The article is solution treated for a predetermined time, and cooled to ambient temperature.

8 Claims, 3 Drawing Sheets

(56) References Cited

U.S. PATENT DOCUMENTS

| | | | |
|---|---|---|---|
| 4,614,550 | A | 9/1986 | Leonard et al. |
| 4,624,716 | A | 11/1986 | Noel et al. |
| 4,652,315 | A | 3/1987 | Igarashi et al. |
| 4,750,944 | A | 6/1988 | Snyder et al. |
| 4,777,017 | A | 10/1988 | Khan et al. |
| 4,788,036 | A | 11/1988 | Eiselstein et al. |
| 4,793,868 | A | 12/1988 | Chang |
| 4,798,632 | A | 1/1989 | Yonezawa et al. |
| 4,814,023 | A | 3/1989 | Chang |
| 4,837,384 | A | 6/1989 | Khan et al. |
| 4,888,253 | A | 12/1989 | Snyder et al. |
| 4,981,644 | A | 1/1991 | Chang |
| 5,006,163 | A | 4/1991 | Benn et al. |
| 5,047,091 | A | 9/1991 | Khan et al. |
| 5,077,004 | A | 12/1991 | Schweizer et al. |
| 5,087,305 | A | 2/1992 | Chang |
| 5,104,614 | A | 4/1992 | Ducrocq et al. |
| 5,154,884 | A | 10/1992 | Wukusick et al. |
| 5,156,808 | A | 10/1992 | Henry et al. |
| 5,244,515 | A | 9/1993 | Miglin |
| 5,306,358 | A | 4/1994 | Lai et al. |
| 5,403,546 | A | 4/1995 | Khan et al. |
| 5,431,750 | A | 7/1995 | Kawai et al. |
| 5,435,861 | A | 7/1995 | Khan et al. |
| 5,527,403 | A | 6/1996 | Schirra et al. |
| 5,529,643 | A | 6/1996 | Yoon et al. |
| 5,556,594 | A | 9/1996 | Frank et al. |
| 5,811,168 | A | 9/1998 | Rasky et al. |
| 5,863,494 | A | 1/1999 | Nazmy et al. |
| 5,916,382 | A | 6/1999 | Sato et al. |
| 6,106,767 | A | 8/2000 | Kennedy et al. |
| 6,193,823 | B1 | 2/2001 | Morra |
| 6,315,846 | B1 | 11/2001 | Hibner et al. |
| 6,328,827 | B1 | 12/2001 | Bouzidi et al. |
| 6,447,624 | B2 | 9/2002 | Nonomura et al. |
| 6,531,002 | B1 | 3/2003 | Henry et al. |
| 6,605,164 | B2 | 8/2003 | Kennedy et al. |
| 6,730,264 | B2 | 5/2004 | Cao |
| 6,755,924 | B2 | 6/2004 | Harrison et al. |
| 6,997,994 | B2 | 2/2006 | Sudo |
| 7,156,932 | B2 | 1/2007 | Cao et al. |
| 7,416,618 | B2 | 8/2008 | Mannan et al. |
| 7,491,275 | B2 | 2/2009 | Cao et al. |
| 7,527,702 | B2 | 5/2009 | Cao et al. |
| 7,531,054 | B2 | 5/2009 | Kennedy et al. |
| 7,537,725 | B2 | 5/2009 | Groh et al. |
| H2245 | H | 8/2010 | Heck et al. |
| 7,854,064 | B2 | 12/2010 | Malley |
| 7,985,304 | B2 | 7/2011 | Cao et al. |
| 8,083,872 | B2 | 12/2011 | Michell et al. |
| 8,394,210 | B2 | 3/2013 | Cao et al. |
| 2001/0026769 | A1 | 10/2001 | Kobayashi et al. |
| 2002/0041821 | A1 | 4/2002 | Manning et al. |
| 2009/0087338 | A1* | 4/2009 | Mitchell ..... C22C 1/0433 420/448 |
| 2010/0329883 | A1 | 12/2010 | Maurer et al. |
| 2012/0037280 | A1 | 2/2012 | Devaux |
| 2017/0164426 | A1 | 6/2017 | Rakowski |

FOREIGN PATENT DOCUMENTS

| | | | |
|---|---|---|---|
| CN | 1492065 | A | 4/2004 |
| CN | 102181752 | A | 9/2011 |
| EP | 0132055 | A1 | 1/1985 |
| EP | 0147616 | A1 | 7/1985 |
| EP | 0234172 | A2 | 9/1987 |
| EP | 0866145 | B1 | 5/2003 |
| GB | 1332061 | A | 10/1973 |
| GB | 2236113 | A | 3/1991 |
| JP | 60-200936 | | 10/1985 |
| JP | 61-565 | A | 1/1986 |
| JP | 64-36739 | U | 3/1989 |
| JP | 4-280938 | | 10/1992 |
| JP | 10-219402 | A | 8/1998 |
| JP | 10-237574 | A | 9/1998 |
| JP | 2000-1754 | A | 1/2000 |
| JP | 2004-107777 | A | 4/2004 |
| JP | 2007-9279 | A | 1/2007 |
| JP | 2009-149976 | A | 7/2009 |
| RU | 1360232 | C | 8/1994 |
| RU | 2418880 | C2 | 5/2011 |
| SU | 351922 | | 9/1972 |
| WO | WO 03/097888 | A1 | 11/2003 |
| WO | WO 2005/038069 | A1 | 4/2005 |
| WO | WO 2009/054756 | A1 | 4/2009 |
| WO | WO 2010/089516 | A2 | 8/2010 |
| WO | WO 2012/047352 | A2 | 4/2012 |

OTHER PUBLICATIONS

Aerospace Material Specification—AMS 5442, issued Sep. 2006, 8 pages.

Allvac® 718 Alloy Technical Data Sheet dated Dec. 31, 2001, 2 pages.

Allvac® 718 Plus™ Alloy Technical Data Sheet dated May 6, 2005, 3 pages.

Allvac® 718Plus® Alloy Technical Data Sheet dated Aug. 3, 2005, 3 pages.

A€ivacc 718 Alloy Technical Data Sheet dated Dec. 31, 2001, 2 pp..

Allyn® 718 Plus Alloy Technical Data Sheet dated May 6, 2005, 32a, es.

Andrieu et al. "Effect of Environment and Microstructure on the High Temperature Behavior of Alloy 718" Superalloy 718—Metallurgy and Applications, E.A. Loria ed., The Minerals, Metals & Materials Society, 1989, pp. 241-256.

Andrieu et al. "Influence of Compositional Modifications on Thermal Stability of Alloy 718," Superalloys 718, 625, 706 and Various Derivatives, ed. E.A. Loria, The Minerals, Metals & Materials Society, 1994, pp. 695-710.

Antony et al., "Thermal Fatigue Resistance of Alloy 718 for Aluminum Die Casting Dies," Superalloys 718, 625, 706 and Various Derivatives, Edited by E.A. Loria, The Minerals, Metals & Materials Society, 2001, pp. 657-667.

ASM Handbook, vol. 14, fourth printing, (1996), electronic file, pp. 1-18.

Azadian et al., "Precipitation in Spray-Formed in 718," Superalloys 718, 625, 706 and Various Derivatives, the Minerals, Metals & Materials Society, E.A. Loria ed., 2001, pp. 617-626.

Barker et al., "Thermomechanical Processing of Inconel 718 and Its Effect on Properties" Advanced High Temperature Alloy: Processing and Properties, ASM, 1986, pp. 125-137.

Bond et al., "Evaluation of Allvac® 718PLUS™ Alloy in the Cold Worked and Heat Treated Condition," Superalloys 718, 625, 706 and Derivatives 2005, ed. E.A. Loria, The Minerals, Metals & Materials Society, 2005, pp. 203-211.

Burke et al., "Microstructure and Properties of Direct-Aged Alloy 625," Superalloys 718, 625, 706 and Various Derivatives, E.A. Loria Ed., The Minerals, Metals and Materials Society, 2001 pp. 389-398.

Cao et al., "Effect and Mechanism of Phosphorous and Boron on Creep Deformation of Alloy 718," Superalloys 718, 625, 706 and Various Derivatives, ed. E.A. Loria, 1997, pp. 511-520.

Cao et al., "Phosphorous-Boron Interaction in Nickel-Base Superalloys," Superalloys 1996, The Minerals, Matels & Materials Society, 1996, pp. 589-597.

Cao et al., "Production Evaluation of 718-ER® Alloy," Superalloys 2000, The Mineral, Metals & Materials Society, 2000, pp. 101-108.

Cao et al., "The Effect of Phosphorous on Mechanical Properties of Alloy 718," Superalloys 718, 625, 706 and Various Derivatives, 1994, pp. 463-477.

Chang et al., "Rene 220: 100° F Improvement Over Alloy 718," Superalloy 718—Metallurgy and Applications, The Minerals, Metals & Materials Society, ed. E.A. Loria, 1989, pp. 631-645.

Collier et al., "On Developing a Microstructurally and Thermally Stable Iron-Nickel Base Superalloy," S. Reichman et al. eds., Superalloys 1988, The Metallurgical Society, 1988, pp. 43-52.

(56) References Cited

OTHER PUBLICATIONS

Collier et al., "The Effect of Varying Al, Ti, and Nb Content on the Phase Stability of INCONEL 718," Metallurgical Transactions A, vol. 19A, Jul. 1988, pp. 1657-1666.
Connelley et al., "Effect of Oxidation on High Temperature Fatique Crack Initiation and Short Crack Growth in Inconel 718", Supperalloys 2000, The Materials, Metals and Materials Society, Jan. 1, 2000, pp. 435-443.
Cozar et al., "Morphology of Y' and Y" Precipitates and Thermal Stability of Inconel 718 Type Alloys," Metallurgical Transactions, vol. 4, Jan. 1973, pp. 47-59.
Davis, J.R., "Nickel, Cobalt and Their Alloys," 2000, ASM International, Ohio, p. 33.
Du et al., "Microstructure and Mechanical Properties of Novel 718 Superalloy," Acta Metallurgical Sinica (English Letters), vol. 19, No. 6, Dec. 2006, pp. 418-424.
Guo et al., "Further Studies on Thermal Stability of Modified 718 Alloys," Superalloys 718, 625, 706 and Various Derivatives, ed. E.A. Loria, The Minerals, Metals & Materials Society, 1994, pp. 721-734.
Guo, Encai et al., "Improving Thermal Stability of Alloy 718 Via Small Modifications in Composition," Superalloy 718—Metallurgy and Applications, E.A. Loria ed., The Minerals, Metals & Materials Society, Warrendale, PA (1989,) pp. 567-576.
Horvath et al., "The Effectiveness of Direct Aging on Inconel 718 Forgings Produced at High Strain Rates as Obtained on a Screw Press," Superalloys 718, 625, 706 and Various Derivatives, E.A. Loria Ed., The Mineral, Metals & Materials Society, 2001, pp. 223-228.
Kennedy et al. "Developments in Wrought Nb Containing Superalloys (718 + 100 F)," Proceedings of the International Symposium on Niobium for High Temperature Application, Araxa, Brazil, Dec. 1-3, 2003, Published by TMS, indexed by Chemical Abstracts Service, Oct. 25, 2004, 12 pages.
Kennedy et al., "Stress-rupture Strength of Alloy 718," Advanced Materials & Processes, ed. E.A. Loria, vol. 149, No. 3, Mar. 1996, pp. 33-35.
Kennedy, R. L., "Allvac® 718PLUS™, Superalloy for the Next Forty Years," Superalloys 718, 625, 706 and Derivatives 2005, ed. E.A. Loria, The Minerals, Metals & Materials Society, 2005, pp. 1-14.
Key to Metals Nonferrous, "Heat Treating of Nickel and Nickel Alloys," printed from http://www.key-to-nonferrous.com/default.aspx?ID=CheckArticle&NM=on Mar. 10, 2008, 3 pages.
Krueger, "The Development of Direct Age 718 for Gas Turbine Engine Disk Applications," Superalloy 718—Metallurgy and Applications, E.A. Loria Ed., The Minerals, Metals & Materials Society, 1989, pp. 279-296.
Mannan et al., "Physical Metallurgy of Alloys 718, 725, 725HS, 925 for Service in Aggressive Corrosive Environments," Special Metals Corporation, Huntington, West Virginia, undated, 12 pages.
Manriquez et al., "The High Temperature Stability of IN718 Derivative Alloys," Antolovich et al, eds., The Minerals, Metals & Materials Society (1992) pp. 507-516.
Metals Handbook®, Tenth edition, vol. 1, Properties and Selection: Irons, Steels, and High-Performance Alloys, ASM International, 1990, p. 982.
Oradie-Basie and J. F. Radavich, "A Current T-T-T Diagram for Wrought Alloy 718", Superalloys 718, 625 and Various Derivatives, Editor E. A. Loria, The Minerals, Metals & Materials Society, 1991, pp. 325-335.
Premium Quality H-13 Steel, Simalex, Custom Pressure Die Casting, printed from http://www.simalex.com/h13.htm on Oct. 30, 2007, 5 pages.
Radavich et al. "Effects of Processing and Thermal Treatments on Alloy 720," Proceedings of the Tenth international Conference on Vacuum Metallurgy, vol. I, Beijing, P.R. China, 1990, pp. 42-53.
Schafrik et al., "Application of Alloy 718 in GE Aircraft Engines: Past, Present and the Next Five Years," Superalloys 718, 625, 706 and Various Derivatives, 2001, pp. 1-11.
Technical Data Blue Sheet, Allegheny Ludlum Altemp® 718 Alloy Nickel-Base Superalloy (UNS Designation N07718), Allegheny Ludlum Corp., Pittsburgh, Pennsylvania, 1998, pp. 1-4.
Warren et al., "Interrelationships Between Thermomechanical Treatment, Microstructure and Properties of Nickel Base Superalloys," as printed from http://www.ts.mah.se/forskn/mumat/Research_topic_rw.htm. printed on Jul. 17, 2003, 3 pages.
Warren et al., "The Cyclic Fatigue Behavior of Direct Age 718 and 149, 315, 454 and 538 ° C.," Materials Science & Encineering, a vol. 428, 2006, pp. 106-115.
Xie et al. "The Role of Phosphorus and Sulfur in Inconel 718," Superalloys 1996, Kissinger et al. eds., The Minerals, Metals & Materials Society, 1996, pp. 599-506.
Xie et al., "Segregation Behavior of Phosphorous and Its Effect on Microstructure and Mechanical Properties in Alloy System Ni—Cr—Fe—Mo—Nb—Ti—Al," Superalloys 718, 625, 706 and Various Derivatives, The Minerals, Metals & Materials Society, ed. E.A. Loria, 1997, pp. 531-542.
Xie et al., "The Role of Mg on Structure and Mechanical Properties in Alloy 718," Superalloys 1988, The Metallurgical Society, S. Reichman et al. eds., 1988, pp. 635-642.
Xie et al., "TTT Diagram of a Newly Developed Nickel-base Superally—Allvac® 718Plus™", Proceedings: Superalloys 718, 625, 706 and Derivatives 2005, Editor E.A. Loria, The Minerals, Metals & Materials Society, 2005, pp. 193-202.
Stotter et al., "Characterization of δ-phase in superalloy Allvac 718Plus", International Journal of Materials Research, 2008, vol. 99, Issue 4, pp. 376-380.
Bingzhe et al., Discussion on Process "Isothermal Forging + Direct Aging" for GH4169 Alloy, Chinese Journal of Rare Metals, Jan. 2002, vol. 26, No. 1, pp. 7-11.
Technical Data Sheet, ATI 718Plus® Alloy Precipitation Hardened Nickel-base Superalloy (UNS N07818), Apr. 11, 2013, pp. 1-5.
Response to Non-Final Office Action for U.S. Appl. No. 12/046,871 dated Nov. 18, 2009.
Donachie et al., Superalloys: A Technical Guide, 2nd Edition, ASM International, Materials Park, OH, USA, 2002, p. 30.
Khimushin F.F., "Heat-Resistant Alloys Based on Nickel", Heat Resistant Steels and Alloys, 1964, Metallurgiya Publishers, Moscow, p. 373.
Dempster et al., "Heat Treatment Metallurgy of Nickel-Base Alloys", Heat Treating of Nonferrous Alloys, vol. 4E, ASM Handbook, ASM International, 2016.

* cited by examiner

METHODS FOR PROCESSING NICKEL-BASE ALLOYS

BACKGROUND OF THE TECHNOLOGY

Field of Technology

The present disclosure relates to methods for heat treating powder metallurgy nickel-base alloy articles. The present disclosure also is directed to powder metallurgy nickel-base alloys produced by the method of the present disclosure, and to articles including such alloys.

Description of the Background of the Technology

Powder metallurgy nickel-base alloys are produced using powder metallurgical techniques such as, for example, consolidating and sintering metallurgical powders. Powder metallurgy nickel-base alloys contain nickel as the predominant element, along with concentrations of various alloying elements and impurities, and may be strengthened by the precipitation of gamma prime (γ') or a related phase during heat treatment. Components and other articles produced from powder metallurgy nickel-base alloys, e.g., discs for gas turbine engines, typically undergo thermo-mechanical processing to form the shape of the articles, and are heat treated afterwards. For example, the articles are forged and isothermally solution heat treated at a temperature below the γ' solvus (subsolvus), followed by quenching in suitable medium, e.g., air or oil. A solution heat treatment below the γ' solvus can result in a fine grain microstructure. The solution heat treatment may be followed by a lower temperature aging heat treatment to relieve residual stresses that develop as a result of the quench and/or to produce a distribution of γ' precipitates in a gamma (γ) matrix.

In conventional processes, forged powder metallurgy nickel-base alloy articles are placed in a furnace at a start temperature in the furnace that is within 30° C. of the solution heat treatment temperature. The furnace set point is then recovered so that the articles reach the solution heat treatment temperature as fast as possible for completing the required heat treatment. However, the likelihood of critical grain growth in the articles may be increased by this conventional method of heat treating. Thus, there has developed a need for improved methods that overcome the limitations of conventional processes that increase the likelihood of critical grain growth in powder metallurgy nickel-base alloy articles.

SUMMARY

The present disclosure, in part, is directed to methods and alloy articles that address certain of the limitations of conventional approaches for heat treating powder metallurgy nickel-base alloy articles. Certain embodiments herein address limitations of conventional processes regarding the heat treat recovery time for solution heat treating, e.g., the time it takes for powder metallurgy nickel-base alloy articles to reach the solution heat treatment temperature. One non-limiting aspect of the present disclosure is directed to a method for heat treating a powder metallurgy nickel-base alloy article comprising: placing the article in a furnace at a start temperature in the furnace that is 80° C. to 200° C. below a gamma prime solvus temperature; increasing the temperature in the furnace to a solution temperature at a ramp rate in the range of 30° C. per hour to 70° C. per hour; solution treating the article for a predetermined time; and cooling the article to ambient temperature. In certain non-limiting embodiments of the method, the ramp rate is in the range of 50° C. per hour to 55° C. per hour.

Another non-limiting aspect of the present disclosure is directed to a powder metallurgy nickel-base alloy article prepared by a process comprising: placing the article in a furnace at a start temperature in the furnace that is 80° C. to 200° C. below a gamma prime solvus temperature; increasing the temperature in the furnace to a solution temperature at a ramp rate of 30° C. per hour to 70° C. per hour; solution treating the article for a predetermined time; and cooling the article to ambient temperature.

BRIEF DESCRIPTION OF THE DRAWING

Features and advantages of the methods and alloy articles described herein may be better understood by reference to the accompanying drawings in which.

It should be understood that the invention is not limited in its application to the arrangements illustrated in the above-described drawings. The reader will appreciate the foregoing details, as well as others, upon considering the following detailed description of certain non-limiting embodiments of methods and alloy articles according to the present disclosure. The reader also may comprehend certain of such additional details upon using the methods and alloy articles described herein.

DETAILED DESCRIPTION OF CERTAIN NON-LIMITING EMBODIMENTS

In the present description of non-limiting embodiments and in the claims, other than in the operating examples or where otherwise indicated, all numbers expressing quantities or characteristics of ingredients and products, processing conditions, and the like are to be understood as being modified in all instances by the term "about." Accordingly, unless indicated to the contrary, any numerical parameters set forth in the following description and the attached claims are approximations that may vary depending upon the desired properties one seeks to obtain in the methods and alloy articles according to the present disclosure. At the very least, and not as an attempt to limit the application of the doctrine of equivalents to the scope of the claims, each numerical parameter should at least be construed in light of the number of reported significant digits and by applying ordinary rounding techniques.

Figure 1:
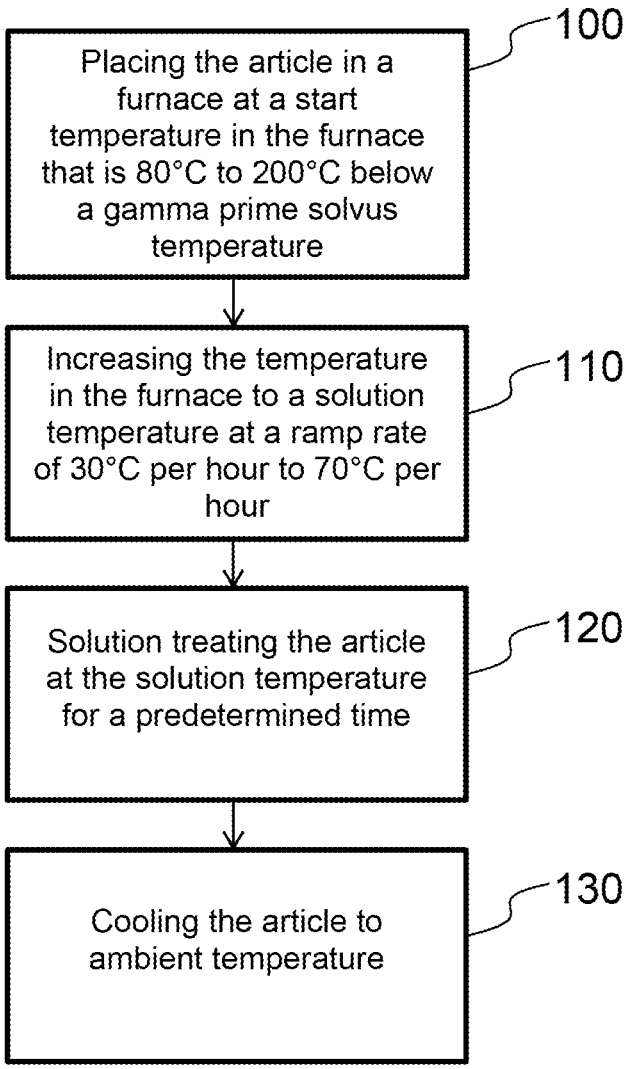
FIG. 1 is a flow chart of a non-limiting embodiment of a method for heat treating a powder metallurgy nickel-base alloy article according to the present disclosure.

The present disclosure, in part, is directed to methods and alloy articles that address certain of the limitations of conventional approaches for heat treating powder metallurgy nickel-base alloy articles. Referring to FIG. 1, a non-limiting embodiment of a method according to the present disclosure for heat treating powder metallurgy nickel-base alloy articles is illustrated. The method includes placing the article in a furnace at a start temperature in the furnace that is 80° C. to 200° C. below a gamma prime solvus temperature (block 100), increasing the temperature in the furnace to a solution temperature at a ramp rate in the range of 30° C. per hour to 70° C. per hour (block 110), solution treating the article for a predetermined time (block 120), and cooling the article to ambient temperature (block 130). The solution heat treatment may be followed by a lower temperature aging heat treatment to relieve residual stresses that develop as a result of the quench, and/or to produce a distribution of γ' precipitates in a gamma γ matrix.

According to certain non-limiting embodiments, the nickel-base alloy comprises, in weight percentages, 8 to 20.6 cobalt, 13.0 to 16.0 chromium, 3.5 to 5.0 molybdenum, 2.1 to 3.4 aluminum, 3.6 to 3.7 titanium, 2.0 to 2.4 tantalum, up to 0.5 hafnium, 0.04 to 0.06 zirconium, 0.027 to 0.06 carbon, up to 0.025 boron, up to 0.9 niobium, up to 4 tungsten, up to 0.5 iron, nickel, and incidental impurities. In certain non-limiting embodiments, the alloy includes 0.5 hafnium. More generally, the methods described herein may be used in connection with the heat treatment of powder metallurgy nickel-base alloys. In certain non-limiting embodiments, the alloy includes 0.5 hafnium. Non-limiting examples of powder metallurgy nickel-base alloys that can be processed in accordance with various non-limiting embodiments disclosed herein include the alloys in Table 1. It will be appreciated by those skilled in the art that the alloy compositions in Table 1 refer only to the major alloying elements contained in the nickel-base alloy on a weight percent basis of the total alloy weight, and that these alloys may also include other minor additions of alloying elements.

TABLE 1

| Alloy | Ni | C | Cr | Mo | W | Co | Nb | Ti | Al | Zr | B | Ta | Hf |
|---|---|---|---|---|---|---|---|---|---|---|---|---|---|
| RR1000 | Bal. | 0.020-0.034 | 14.6-15.4 | 4.75-5.25 | — | 18-19 | — | 3.4-3.8 | 2.8-3.2 | 0.05-0.07 | 0.005-0.025 | 1.82-2.18 | 0.4-0.6 |
| René 88 | Bal. | 0.010-0.060 | 15-17 | 3.5-4.5 | 3.5-4.5 | 12-14 | 0.5-1.0 | 3.2-4.2 | 1.5-2.5 | 0.01-0.06 | 0.010-0.040 | — | — |
| René 104 (ME3) | Bal. | 0.02-0.10 | 6.6-14.3 | 1.9-3.9 | 1.9-4.0 | 16.0-22.4 | 0.9-3.0 | 2.4-4.6 | 2.6-4.8 | 0.03-0.10 | 0.02-0.10 | 1.4-3.5 | — |
| René 95 | Bal. | 0.04-0.09 | 12-14 | 3.3-3.7 | 3.3-3.7 | 7-9 | 3.3-3.7 | 2.3-2.7 | 3.3-3.7 | 0.03-0.07 | 0.006-0.015 | — | — |

Although the present description references certain specific alloys, the methods and alloy articles described herein are not limited in this regard, provided that they relate to powder metallurgy nickel-base alloys. A "powder metallurgy nickel-base alloy" is a term of art and will be readily understood by those having ordinary skill in the production of nickel-base alloys and articles including such alloys. Typically, a powder metallurgy nickel-base alloy is compacted to densify the loose powder mass. The compacting is conventionally performed by hot isostatic pressing (also referred to as "HIPping") or extrusion, or both.

Figure 2:
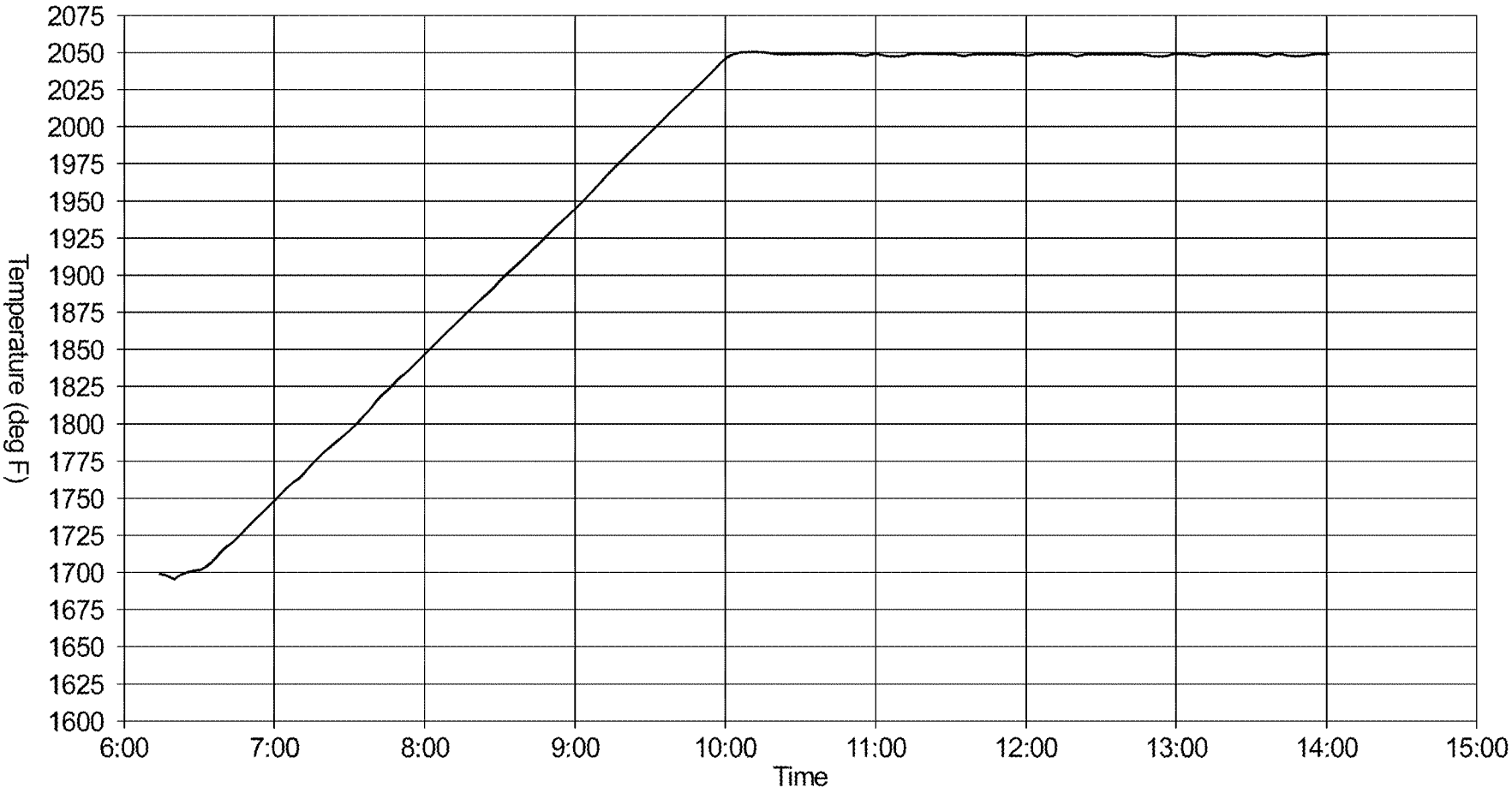
FIG. 2 is a graph plotting the temperature in the furnace as a function of time for a non-limiting embodiment of a method for heat treating a powder metallurgy nickel-base alloy article according to the present disclosure.
Figure 3:
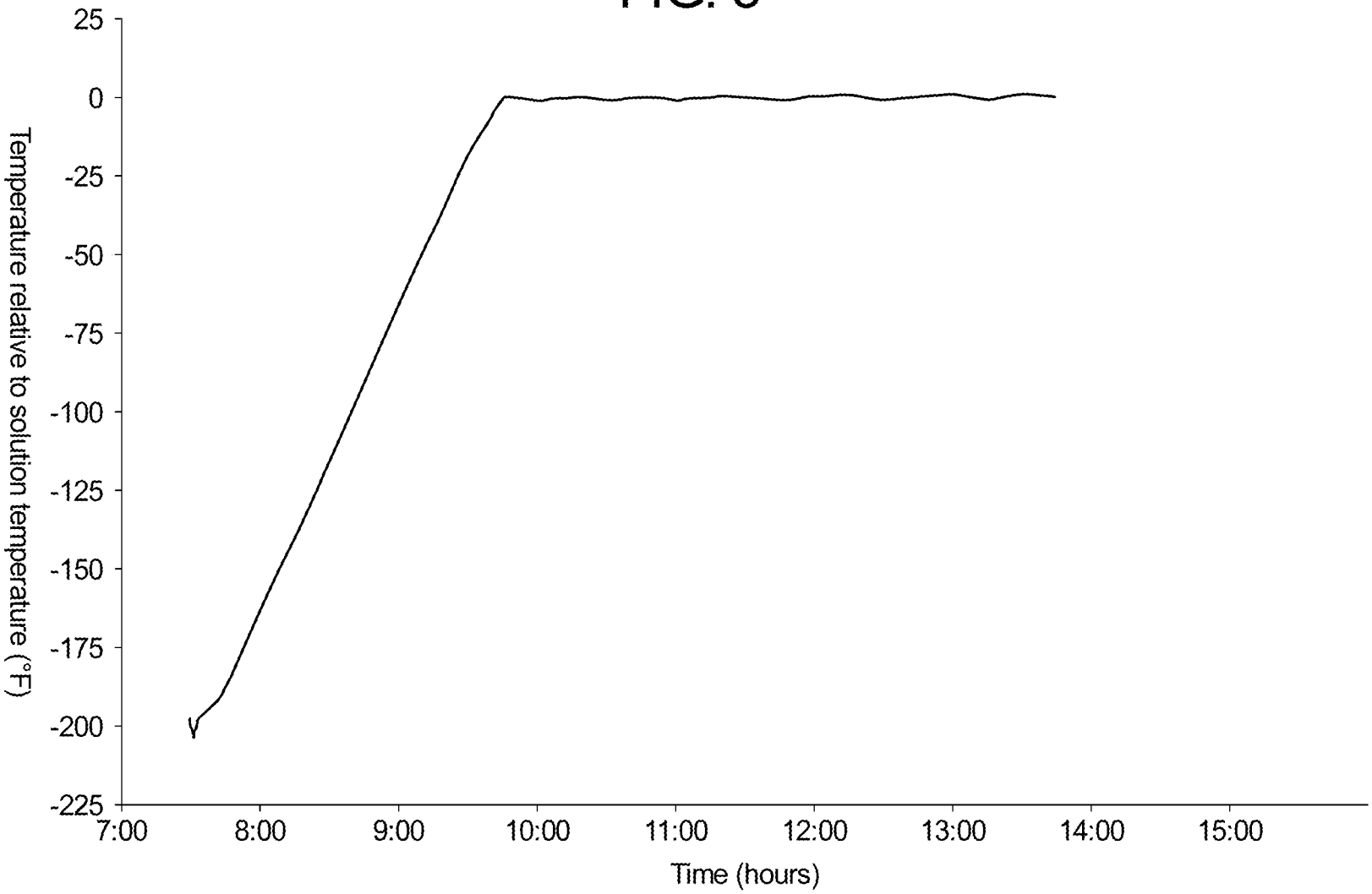
FIG. 3 is a graph plotting the temperature in the furnace relative to solution temperature as a function of time for another non-limiting embodiment of a method for heat treating a powder metallurgy nickel-base alloy article according to the present disclosure.

Referring to FIGS. 2-3, in certain non-limiting embodiments, the start temperature in the furnace is 110° C. to 350° C. below the γ' solvus temperature of the particular powder metallurgy nickel-base alloy. For example, if the γ' solvus temperature is 1150° C., the start temperature in the furnace can be 800° C. to 1040° C. Typical γ' solvus temperatures of powder metallurgy nickel-base alloy are 1120° C. to 1190° C. Therefore, the start temperature in the furnace is generally within the range of 770° C. to 1080° C. According to certain non-limiting embodiments, the start temperature in the furnace is 160° C. to 200° C. below the alloy's γ' solvus temperature. According to certain particular non-limiting embodiments, the start temperature in the furnace is 200° C. below the alloy's γ' solvus temperature.

According to certain non-limiting embodiments, the ramp rate is in the range of 30° C. per hour to 70° C. per hour. According to certain non-limiting embodiments, the ramp rate is in the range of 50° C. per hour to 70° C. per hour, or in the range of 50° C. per hour to 55° C. per hour. For example, if the ramp rate is 55° C. per hour, and the furnace is ramped from 927.5° C. to 1120° C., the time required to complete the ramp is 3.5 hours. Depending on the usage requirement or preferences for the particular alloy article, a ramp rate faster than 70° C. per hour may not provide the requisite grain structure or other desired properties, as further explained below. On the other hand, a ramp rate slower than 30° C. per hour may not be economically feasible due to the increased time required to complete the heat treatment. According to certain non-limiting embodiments, the ramp rate is a constant rate. That is, the instantaneous rate is constrained to be uniform throughout the step of increasing the temperature. According to other embodiments, the ramp rate may have slight variations over the ramp cycle. According to certain non-limiting embodiments, the average ramp rate falls within the range of 50° C. per hour to 70° C. per hour, wherein the instantaneous ramp rate is always within the range of 50° C. per hour to 70° C. per hour.

According to certain non-limiting embodiments, the article is solution treated for 1 hour up to 10 hours such that the material is of uniform composition and properties. For example, the article can be solution treated in the range of 1 hour to 10 hours, 1 hour to 9 hours, 1 hour to 8 hours, 1 hour to 7 hours, 1 hour to 6 hours, 1 hour to 5 hours, 1 hour to 4 hours, 1 hour to 3 hours, or 1 hour to 2 hours. According to certain non-limiting embodiments, the solution temperature is at least 10° C. below the γ' solvus. For example, the solution temperature for the RR1000 alloy can be 1120° C. According to certain non-limiting embodiments, the article is maintained at the solution temperature with a temperature tolerance of ±14° C. According to other embodiments, the article is maintained at the solution temperature with a temperature tolerance of ±10° C. According to other embodiments, the article is maintained at the solution temperature with a temperature tolerance of ±8° C. According to further embodiments, the temperature tolerance can vary, so long as the article is maintained at a temperature not exceeding the γ' solvus temperature. As used herein, phrases such as "maintained at" with reference to a temperature, temperature range, or minimum temperature, mean that at least a desired portion of the powder metallurgy nickel-base alloy reaches, and is held at, a temperature at least equal to the referenced temperature or within the referenced temperature range.

According to certain non-limiting embodiments, the article is cooled to ambient temperature after the solution heat treatment. According to certain non-limiting embodiments, the article is quenched in a medium, e.g., air or oil, so that a temperature of the entire cross-section of the article (e.g., center to surface of the article) cools at a rate of at least 0.1° C./second. According to other embodiments, the article is control cooled at other cooling rates.

According to certain non-limiting embodiments, the powder metallurgy nickel-base alloy produced according to various non-limiting embodiments of the methods disclosed herein comprises an average grain size of 10 micrometers or less, corresponding to an ASTM grain size number that is approximately equal to or greater than 10 in accordance with ASTM E112. According to certain non-limiting embodiments, the powder metallurgy nickel-base alloy produced according to various non-limiting embodiments of the methods disclosed herein comprises a coarse grain population and a fine grain population, and the average grain size of the coarse grain population differs from the average grain size of the fine grain population by two ASTM grain size numbers or less (in accordance with ASTM E112). For example, certain non-limiting embodiments of powder metallurgy nickel-base alloy produced according to various non-limiting embodiments of the methods disclosed herein comprises a coarse grain population having an average grain size of ASTM 10 in accordance with ASTM E112, corresponding to an average grain size of 11.2 μm, and a fine grain population having an average grain size of ASTM 12 in accordance with ASTM E112, corresponding to an average grain size of 5.6 μm. According to further non-limiting embodiments, the coarse grain population has an average grain size of ASTM 10 or finer, and the fine grain population has an average grain size of ASTM 12 or finer, in accordance with ASTM E112. Although examples of possible grain size populations are given herein, these examples do not encompass all possible grain size populations for powder metallurgy nickel-base alloy articles according to the present disclosure. Rather, the present inventors determined that these grain size populations represent possible grain size populations that can be suitable for certain powder metallurgy nickel-base alloy articles processed according to various non-limiting embodiments of the methods disclosed herein. It is to be understood that the methods and alloy articles of the present disclosure may incorporate other suitable grain size populations.

Depending on the use requirements or preferences of the particular method or alloy articles, before the step of placing the article in the furnace at the start temperature, the powder metallurgy nickel-base alloy article is forged. According to further embodiments, additional steps such as, for example, coating, rough, and final machining and/or surface finishing, may be applied to the article before placing the article in the furnace at the start temperature.

Example 1

Referring to FIG. 2, a disk forging of RR1000 alloy was placed in a furnace at a start temperature in the furnace of 927° C. The temperature in the furnace was increased to 1120° C. at a ramp rate of 55° C. per hour. The disk was maintained at 1120° C. for four hours, and then air-cooled to ambient temperature. Subsequently, the disk was milled to remove the oxide layer, and etched to inspect the macro grain structure. The macro inspection revealed a uniform grain structure, with no coarse grain bands at the hub or rim areas. Samples were cut from both the bore hub areas and the rim of the disk, for mounting and micrographic examination. The micrographic examination from the upper hub location did show some grain size banding between the surface and center of the part, with the coarser region at the part surface having an ASTM grain size number of 11.5, and the adjacent matrix having an ASTM grain size number of 12.5. Grain sizes from outer rim and lower hub locations were both uniform with no banding. The outer rim grain size was an ASTM 11.5, and the lower hub grain size was an ASTM 12.

Example 2

Referring to FIG. 3, a disk forging of RR1000 alloy was placed in a furnace at a start temperature in the furnace of 1010° C. The temperature in the furnace was increased to 1120° C. at a ramp rate of 55° C. per hour. The disk was maintained at 1120° C. for four hours, and then air-cooled to ambient temperature. Samples were cut from both the bore hub areas and the rim of the disk, for mounting and micrographic examination. The micrographic examination from the upper hub location did show some grain size banding between the surface and center of the part, with the coarser region having an ASTM grain size number of 10, and the adjacent matrix having an ASTM grain size number of 12. Grain sizes from outer rim and lower hub locations were both uniform with no banding. The outer rim and the lower hub grain sizes were both an ASTM 12.

Example 3

A disk forging of RR1000 alloy is placed in a furnace at a start temperature in the furnace of 927° C. The temperature in the furnace is increased to 1110° C. at a ramp rate of 66° C. per hour. The disk is maintained at 1110° C. for four hours, and then air cooled to ambient temperature.

Example 4

A disk forging of RR1000 alloy is placed in a furnace at a start temperature in the furnace of 927° C. The temperature in the furnace is increased to 1110° C. at a ramp rate of 50° C. per hour. The disk is maintained at 1110° C. for four hours, and then air cooled to ambient temperature.

Non-limiting examples of articles of manufacture that may be fabricated from or include the present powder metallurgy nickel-base alloy produced according to various non-limiting embodiments of the methods disclosed herein are a turbine disc, a turbine rotor, a compressor disc, a turbine cover plate, a compressor cone, and a compressor rotor for aeronautical or land-base turbine engines. Those having ordinary skill can fabricate the articles of manufacture from alloys processed according to the present methods using known manufacturing techniques, without undue effort.

Although the foregoing description has necessarily presented only a limited number of embodiments, those of ordinary skill in the relevant art will appreciate that various changes in the methods and alloy articles and other details of the examples that have been described and illustrated herein may be made by those skilled in the art, and all such modifications will remain within the principle and scope of the present disclosure as expressed herein and in the appended claims. It is understood, therefore, that the present invention is not limited to the particular embodiments disclosed or incorporated herein, but is intended to cover modifications that are within the principle and scope of the invention, as defined by the claims. It will also be appreciated by those skilled in the art that changes could be made to the embodiments above without departing from the broad inventive concept thereof.

We claim:

1. A method for heat treating a powder metallurgy nickel-base alloy article, the method comprising:

placing the article in a furnace at a start temperature in the furnace that is 80° C. to 200° C. below a gamma prime solvus temperature of the nickel-base alloy;

increasing the temperature in the furnace to a solution temperature at a ramp rate in the range of 30° C. per hour to 70° C. per hour;

solution treating the article for a predetermined time; and cooling the article to ambient temperature, wherein the article comprises a powder metallurgy nickel-base alloy comprising, in weight percentages, 18 to 19 cobalt, 14.6 to 15.4 chromium, 4.75 to 5.25 molybdenum, 2.8 to 3.2 aluminum, 3.4 to 3.8 titanium, 1.82 to 2.18 tantalum, 0.4 to 0.6 hafnium, 0.05 to 0.07 zirconium, 0.020 to 0.034 carbon, 0.005 to 0.025 boron, nickel, and incidental impurities.

2. The method of claim 1, wherein the ramp rate is in the range of 50° C. per hour to 70° C. per hour.

3. The method of claim 1, wherein the start temperature is 110° C. to 200° C. below the gamma prime solvus temperature.

4. The method of claim 1, wherein the start temperature is 160° C. to 200° C. below the gamma prime solvus temperature.

5. The method of claim 1, wherein the nickel-base alloy has an average grain size of 10 micrometers or less.

6. The method of claim 1, wherein the nickel-base alloy has a coarse grain population and a fine grain population, and an average grain size of the coarse grain population differs from an average grain size of the fine grain population by at least two ASTM grain size numbers in accordance with ASTM E112.

7. The method of claim 6, wherein the coarse grain population has an average grain size of ASTM 10 or finer, and the fine grain population has an average grain size of ASTM 12 or finer in accordance with ASTM E112.

8. The method of claim 1 comprising, before the step of placing the article in the furnace at the start temperature, forging the powder metallurgy nickel-base alloy article.

* * * * *